US005451095A

United States Patent [19]

Riback

[11] Patent Number: 5,451,095

[45] Date of Patent: Sep. 19, 1995

[54] JUVENILE CRADLE BOUNCER APPARATUS

[75] Inventor: Richard Riback, Deerfield, Ill.

[73] Assignee: Sassy, Inc., Northbrook, Ill.

[21] Appl. No.: 130,657

[22] Filed: Oct. 1, 1993

[51] Int. Cl.[6] ..... A47D 13/10

[52] U.S. Cl. ..... 297/354.12; 297/19; 297/357; 297/440.11; 297/452.13

[58] Field of Search ..... 297/19, 16.1, 183, 188, 297/DIG. 11, 354.12, 328, 357, 423.3, 452.13, 440.11

[56] References Cited

U.S. PATENT DOCUMENTS

| | | | |
|---|---|---|---|
| 3,096,963 | 7/1963 | Welsh | 297/19 X |
| 5,207,478 | 5/1993 | Freese et al. | 297/16.1 X |
| 5,269,591 | 12/1993 | Miga, Jr. et al. | 297/452.13 |
| 5,308,143 | 5/1994 | Cheng et al. | 297/440.11 X |

FOREIGN PATENT DOCUMENTS

| | | | |
|---|---|---|---|
| 1146368 | 11/1957 | France | 297/357 |
| 590848 | 7/1947 | United Kingdom | 297/46 |

*Primary Examiner*—Laurie K. Cranmer
*Attorney, Agent, or Firm*—Dick and Harris

[57] ABSTRACT

A juvenile seat cradle bouncer apparatus of the type having a base portion and a back support member operably attached to the base portion. The back support member is pivotally positionable relative to the base portion between a substantially collapsed orientation and one or more upright angular orientations. Retention members are associated with the base portion for releasably retaining the back support member in a desired one of the upright angular orientations. A foot support member is operably associated with the back support member, and is pivotally attached to the base portion. The foot support member can be pivoted to: a back support member interferring orientation for locking the back support member in a desired one of the upright angular orientations; a back support member clearing orientation for enabling the back support member to be reoriented between a collapsed orientation and one or more upright angular orientations; and a collapsed foot support orientation when the apparatus is to be stored or transported.

23 Claims, 3 Drawing Sheets

Fig 11
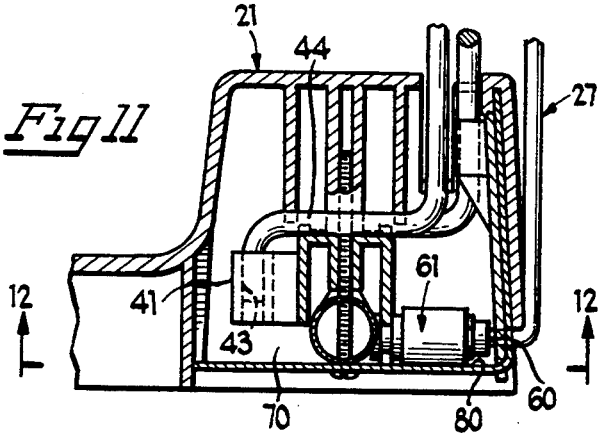
Fig 12
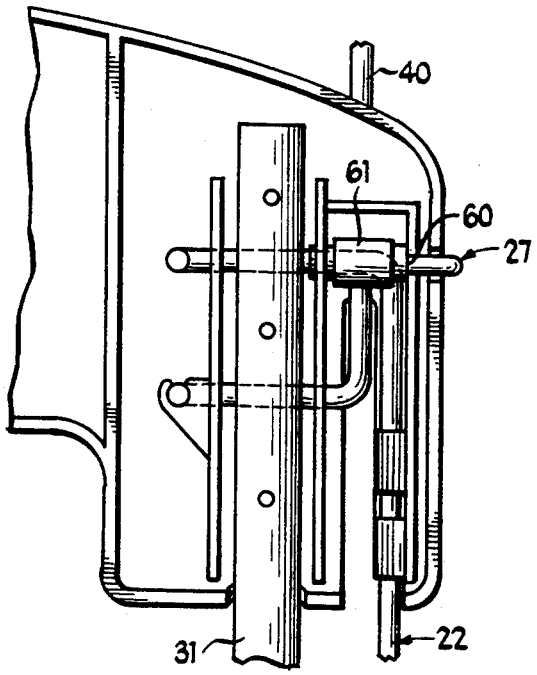
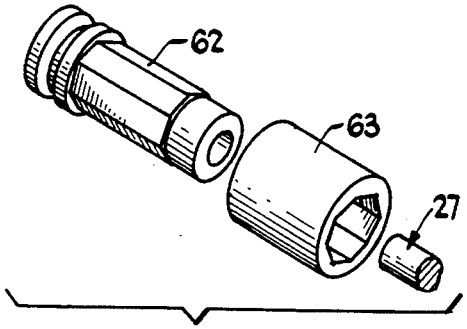
Fig 13
Fig 14
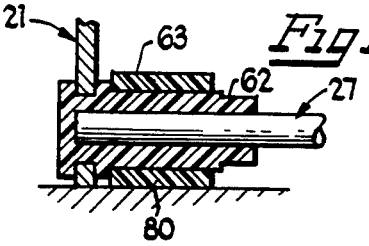
Fig 15
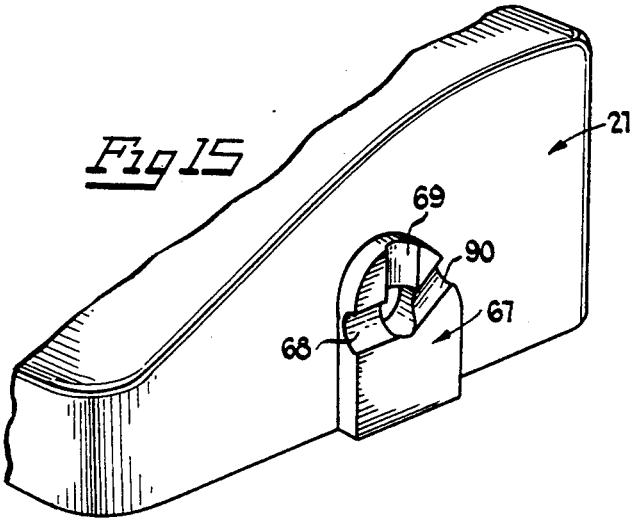
Fig 16
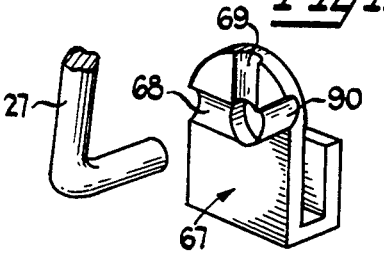

JUVENILE CRADLE BOUNCER APPARATUS

BACKGROUND OF THE INVENTION

The present invention relates to juvenile chairs, and, more particularly, to a juvenile seat and/or cradle bouncer apparatus of the type having a base portion and a back support member.

Juvenile chairs and/or cradle bouncers have been known in the art for several years. Indeed, such prior art devices have included a base portion and a back support member wherein the back support member is positioned at a predetermined angle relative to the base portion, and, in turn, to the underlying surface of the device itself. Although such prior art devices, such as that disclosed in U.S. Pat. No. 4,553,786 and others, have been functional with respect to the usability by a juvenile after the particular device has been fully erected, such devices have not provided means for positioning the back support member between one or more usable orientations—without the necessity of any disassembly and/or reassembly of the back support member to the base portion—nor have they provided means for the pivotal deployment of the back support member, and in turn, the entire device itself, from a substantially collapsed orientation to and from an erected orientation—again, without any need for disassembly of the device.

Although some of such prior art devices may include a foot support member associated with the back support member for purposes of providing a foot rest to a user of the device, none of such prior art has utilized a pivoting foot support or other member which can be alternatively positioned to either lock the back support member in a desired usable orientation relative to the base portion, to enable unlocking and repositioning of the back support member to another angled usable orientation, or to enable collapsed orientation of the foot support member so as to facilitate storage and transporting of the apparatus.

It is thus an object of the present invention to provide a juvenile seat/cradle bouncer apparatus which includes a back support member which can be pivotally positionable between at least two orientations relative to the base portion.

It is also an object of the present invention to provide a juvenile seat/cradle bouncer apparatus wherein at least one of the pivotal orientations of the back support member results in the apparatus being substantially collapsed for ease in storage and transporting of same, and wherein at least one other orientation results in the back support member being positionable at a usable upright angle relative to the base portion—all without the need for any reassembly or disassembly of the apparatus when either of the various orientations are desired.

It is still further an object of the present invention to provide a juvenile seat/cradle bouncer apparatus having a pivoting foot support member which can be pivoted to and from a locked back support member interfering orientation, a released back support member clearing orientation and a foot support collapsed orientation—again, without requiring any reassembly or disassembly of any components of the apparatus to accomplish such orientation.

These and other objects of the present invention will become apparent in light of the present Specification, Claims and Drawings.

SUMMARY OF THE INVENTION

The present invention comprises a juvenile cradle bouncer apparatus of the type having a base portion and a back support member operably attached to the base portion. The apparatus includes positioning means operably associated with the back support member and the base portion for enabling the back support member to be pivotally positionable relative to the base portion into one of at least two orientations. The positioning means include retention means which are operably associated with the base portion for releasably retaining the back support member in at least one of the at least two orientations.

Locking means are operably positioned in the base portion for operable association with the back support member, for releasably locking the back support member within the retention means and, in turn, for releasably locking the back support member in at least one of the at least two orientations. The locking means include a locking member pivotally positionable between a back support member-interfering orientation and a back support member-clearing orientation. The positioning of the locking member in the back support member-clearing orientation enables the back support member to be positionable into one of the at least two orientations. The positioning of the locking member in the back support member-interfering orientation precludes the back support member from being operably released and re-oriented from the desired one of the at least two orientations to another orientation—thereby avoiding collapse of the back support member when a juvenile is seated in the apparatus.

In the preferred embodiment of the invention, the at least two orientations of the back support member comprise the back support member being substantially juxtaposed to the base portion without having to disassemble the back support member from the base portion. Accordingly, such an orientation facilitates collapsibility, storage and transportation of the apparatus.

In another preferred embodiment of the invention, the at least two orientations of the back support member comprise three orientations. Indeed, one of the three orientations comprises the back support member being substantially juxtaposed to the base portion—without having to disassemble the back support member from the base portion—so as to facilitate collapsibility, storage and transportation of the apparatus. The other two of the three orientations comprise the back support member being positionable to various upright acute angles relative to the base portion.

In the preferred embodiment of the invention, the locking member of the locking means comprises a foot support member pivotally attached to the base portion. The foot support member is pivotal to a position substantially juxtaposed to the base portion so as to facilitate collapsibility, storage and transportation of the apparatus.

In this preferred embodiment, the apparatus further includes foot member securement means operably associated with the base portion for releasably securing the foot support member in the back support member-interfering orientation.

In another preferred embodiment, the retention means each comprise a side region operably exposed to at least a portion of the back support member and a top end. The side regions have a cam-like surface and the top ends have a detent. At least a portion of the back support member is pivotally positioned over and past the cam-like surface of the side regions so as to facilitate operable seating of the portion of the back support member in the detents of the respective top ends, to, in turn, releasably retain the back support member in the desired orientation.

The apparatus further comprises a toy bar pivotally associated with the base portion. The toy bar includes a first end region and a second end region. The toy bar further includes position securement means for operably securing the toy bar in two or more desired orientations relative to the base portion. The position securement means are operably associated with at least one of the first and second end regions of the toy bar and the base portion.

The position securement means include friction intensifying means operably associated with at least a portion of at least one of the first and second end regions of the back support means for providing frictional rotational engagement between at least one of the first and second end regions and the base portion. Alternatively, the position securement means may comprise two or more detent regions operably associated with the base portion. In this embodiment, at least one of the first and second end regions of the back support means are pivotally positionable, and, in turn, seatable within a desired one of each of the at least two or more detent regions.

In the preferred embodiment of the invention, the base portion further includes handle means for facilitating carrying of the apparatus when the back support member and the base portion are positioned into a substantially collapsed orientation.

BRIEF DESCRIPTION OF THE DRAWINGS

FIG. 11 of the drawings is a cross-sectional fragmentary front view of the cradle bouncer apparatus showing, in particular, the operable positioning of the friction intensifying means of the toy bar, relative to the inside of the base portion;

FIG. 12 of the drawings is a cross-sectional view of FIG. 11, taken along lines 12—12, showing, in particular, the operable positioning of the toy bar and position securement means within the base portion;

FIG. 13 of the drawings is an exploded perspective view of the position retention means showing, in particular, the first end region of the toy bar, the spool member, and the elastomer which surrounds the spool member;

FIG. 14 of the drawings is a cross-sectional fragmentary view of the position retention means of the toy bar secured to the base portion;

FIG. 15 of the drawings is a fragmentary view of another embodiment of the toy bar position securement means showing, in particular, the end region acceptance hole and the associated detent regions; and FIG. 16 of the drawings is a sectional view of the modular toy bar position securement means of FIG. 15.

DETAILED DESCRIPTION OF THE DRAWINGS

Figure 1:
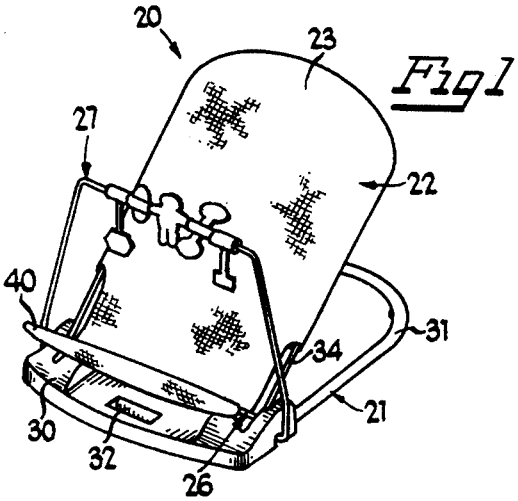
FIG. 1 of the drawings is a perspective view of the juvenile cradle bouncer apparatus showing, in particular, the base portion, the back support member, the lockable foot support member and the toy bar.

While this invention is susceptible of embodiment in many different forms, there is shown in the drawings and will herein be described in detail, several specific embodiments with the understanding that the present disclosure is to be considered as an exemplification of the principles of the invention and is not intended to limit the invention to the embodiments illustrated.

Figure 2:
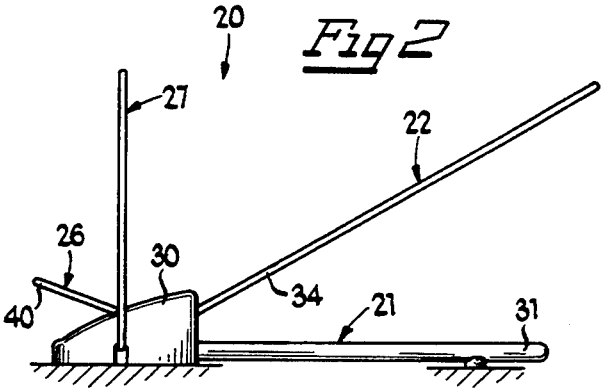
FIG. 2 of the drawings is an elevated side view of the cradle bouncer apparatus showing, in particular, the positioning of the back support member in a substantially upright-angular orientation relative to the base portion, the positioning of the foot support member in a locked, back support member interfering orientation, and the substantially vertical orientation of the toy bar.
Figure 3:
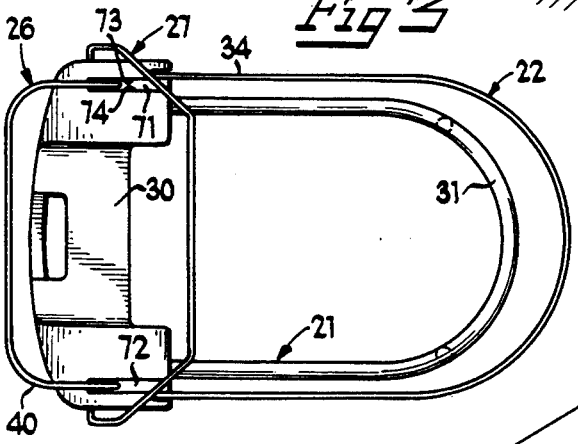
FIG. 3 of the drawings is a top plan view of the cradle bouncer apparatus of FIG. 2.

Juvenile seat, cradle bouncer apparatus 20 is shown in FIG. 1 through FIG. 3 as including base portion 21, back support member 22, positioning means 24 (FIG. 7B), locking means 26, and toy bar 27. Base portion 21 includes front block region 30, base bar 31 and handle 32 (FIG. 1) which is operably formed in front block region 30. The handle facilitates carrying of apparatus 20 when the apparatus is positioned into its substantially collapsed orientation. Front block region 30 includes inner chamber 70 (FIG. 11), and slots 71 and 72 (FIG. 3). Each of the slots include a first wall surface, such as first wall surface 73, and a second wall surface, such as second wall surface 74.

Back support member 22 includes a wire frame 34 having a first end region 35 (FIG. 6), a second symmetrically opposed end region (not shown), and fabric 23 (FIG. 1) which is wrapped about back support member 22 and attached to a portion of locking means 26. Each of the end regions of the wire frame are operably associated with a corresponding pivot channel region, such as pivot channel region 33 (FIG. 6), which is located within inner chamber 70 of the front block region of the base portion, so as to facilitate pivotal positioning of back support member 22, relative to base portion 21, into one of at least two orientations.

Positioning means 24 are shown in FIG. 7A through FIG. 10B as comprising retention means, such as lower retention means 36 and upper retention means 37. Each of the retention means, such as retention means 36 (as shown in detail in FIG. 5), are operably attached to a corresponding first wall surface, such as first wall surface 73 of slot 71. The retention means, such as retention means 36, each include a side region, such as side region 38, exposed to a portion of a corresponding second wall surface, such as second wall surface 74 of slot 71 of front block region 30 of the base portion, and a top end, such as top end 39. The side regions each include a cam-like surface, and each of the top ends of the retention means includes a detent. As will be explained, the retention means serve to releasably retain a portion of the first and second end regions of wire frame 34 of back support member 22, and, in turn, the back support member itself, into one or more upwardly (acute) angled orientations relative to base portion 21.

Figure 5:
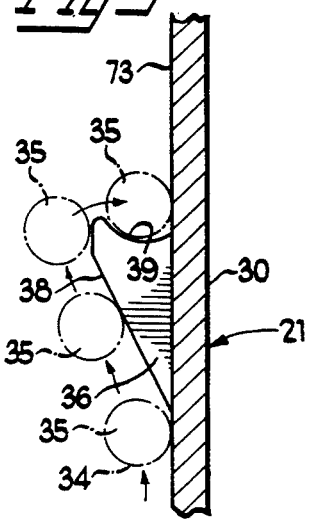
FIG. 5 of the drawings is an enlarged fragmentary cross-sectional view of the base portion taken along lines 5—5 of FIG. 2 and looking in the direction of the arrows, showing, in particular, the cam-like surface of the side region of the retention means as well as the top end of same, and further showing, the path of travel of the end regions of the wire frame of the back support member along the side regions toward and into the detent in the top end of the retention means.
Figure 10A:
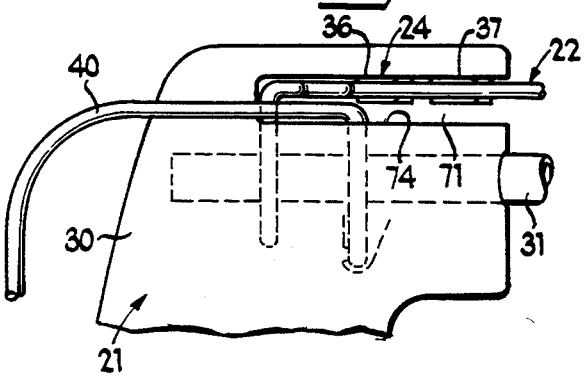
FIG. 10A of the drawings is a top plan fragmentary view of the cradle bouncer apparatus showing, in particular, the positioning of the back support member operably retained in the upper retention means and the locked back support member-interfering orientation of the lockable foot support member—wherein the foot support member is occupying a portion of the void between the side region of the retention means and the adjacent second wall surface of the slot of the front block region of the base portion to restrain the position of the back support member in its upper upright position.
Figure 10B:
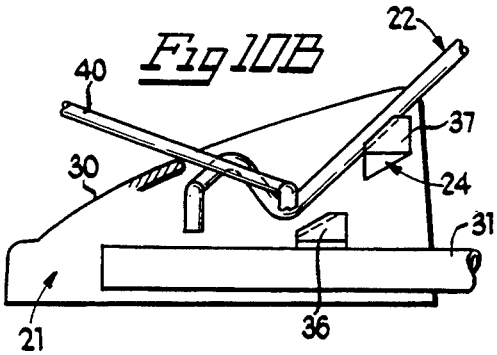
FIG. 10B of the drawings is an elevated side view of FIG. 10A.

Indeed, when such an upwardly angled orientation is desired (such as the angled orientation shown in FIG. 1), an individual may merely grasp a portion of back support member 22 and pivotally push or pull the back support member in a direction up and away from base bar 31 of the base portion. As such pivotal movement is occurring, a portion of the first and second end regions, such as first end region 35 (FIG. 5) of wire frame 34, will come into operable contact with the cam-like surface of side region 38 (FIG. 5). As such upward pivotal motion continues, the first and second end regions of the wire frame will slide up and past the cam-like surface of the side region until it can be springedly snapped into seating within the detent in the corresponding top end, such as top end 39, of the side region. Once such seating has occurred, back support member 22 will be partially restrained in the desired upright angled orientation. Of course, should alternative positioning of back support member 22 at another angle relative to the base portion be desired (such as shown in FIG. 10B), then the individual positioning the back support member would merely continue with the upward pivotal movement of the back support member up and past the top end 39 of lower retention means 36 until operable contact with upper retention means 37 is obtained. Once such alternative contact has occurred, the same procedure would be followed as previously explained with respect to the positioning of the back support member within lower retention means 36. Regardless of positioning, additional securement of the back support member within the desired retention means can be safely maintained through operable cooperation with locking means 26.

Figure 4:
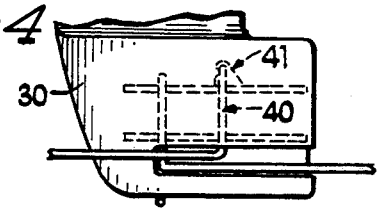
FIG. 4 of the drawings is a fragmentary top plan view of the locking means showing, in particular, the operable positioning of the first end of the lockable foot support member secured within the foot member securement means.
Figure 6:
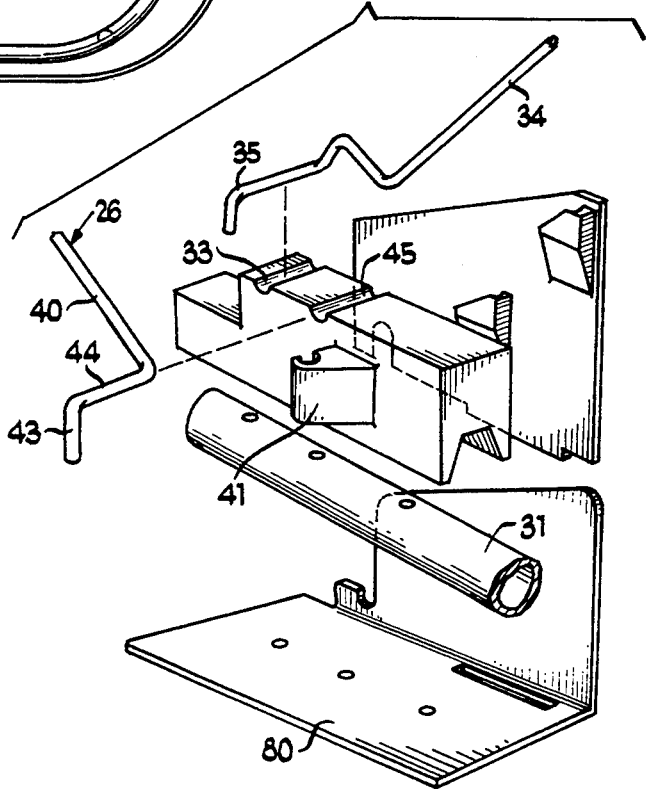
FIG. 6 of the drawings is an exploded fragmentary view of the first end region of the wire frame of the back support member, the first end of the lockable foot support member, the foot member securement means and the channel regions which facilitate pivotal movement of the back support member and the foot support member.
Figure 7A:
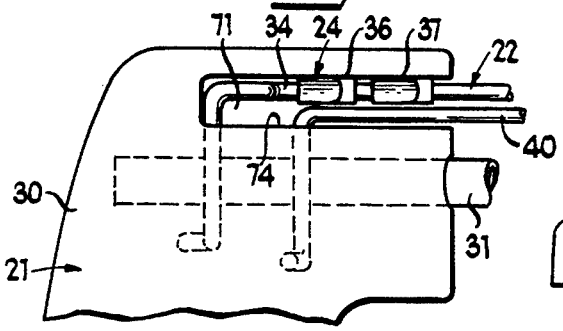
FIG. 7A of the drawings is a fragmentary top plan view of the cradle bouncer apparatus showing, in particular, the collapsed positioning of the back support member and the foot support member.
Figure 7B:
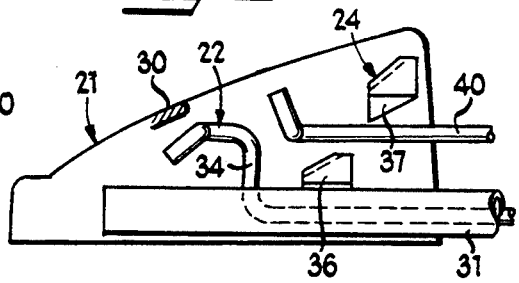
FIG. 7B of the drawings is an elevated side view of FIG. 7A.
Figure 8A:
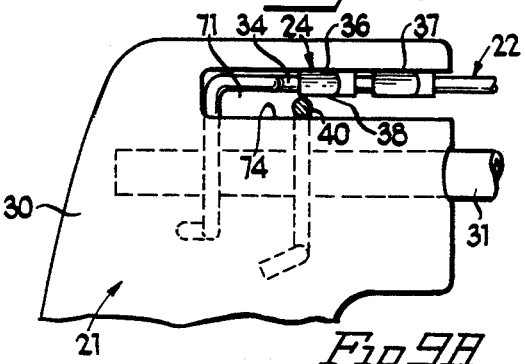
FIG. 8A of the drawings is a top plan fragmentary view of the cradle bouncer apparatus, showing, in particular, the positioning of the back support member in its collapsed orientation and the back support member-clearing orientation of the foot support member.
Figure 8B:
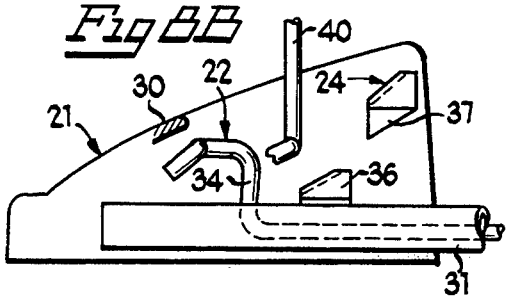
FIG. 8B of the drawings is an elevated side view of FIG. 8A.
Figure 9A:
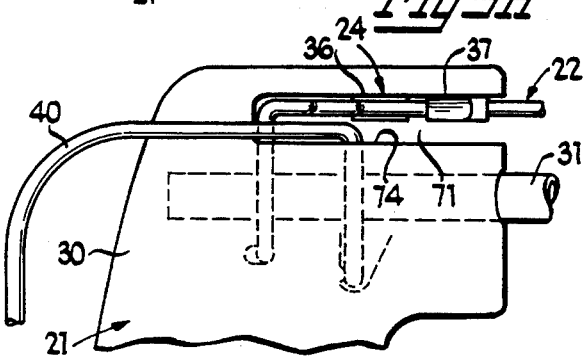
FIG. 9A of the drawings is a top plan fragmentary view of the cradle bouncer apparatus showing, in particular, the positioning of the back support member operably retained in the lower retention means, and the locked back support member-interfering orientation of the foot support member—wherein the foot support member is partially occupying a portion of the void between the side region of the retention means and the adjacent second wall surface of the slot of the front block region of the base portion to restrain the position of the back support member in its lower upright position.
Figure 9B:
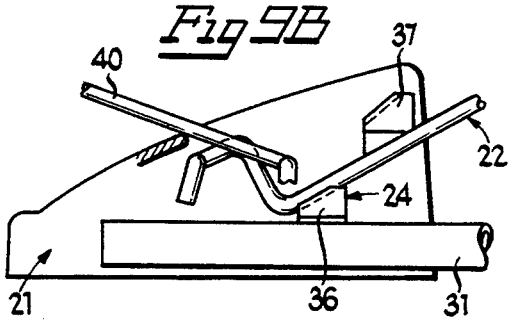
FIG. 9B of the drawings is an elevated side view of FIG. 9A.

Locking means 26 is shown in FIGS. 1 through 3 as including lockable foot support member 40 and foot member securement means 41 (FIG. 4, FIG. 6 and FIG. 11). Foot support member 40 comprises a wire bar having a first end, such as first end 43 (FIG. 6 and FIG. 11), a second symmetrically opposed end (not shown) and a pivot attachment region, such as pivot attachment region 44 (FIG. 6 and FIG. 11). The pivot attachment region operably engages with pivot channel 45 (FIG. 6), located within inner chamber 70 (FIG. 11) of front block region 30 of the base portion when apparatus 20 is fully assembled, so as to facilitate pivotal positioning of lockable foot support member 40 between a back support member interfering orientation (as shown in FIG. 9A through FIG. 10B), a back support member clearing orientation (as shown in FIG. 8A and FIG. 8B), and, a substantially collapsed orientation (as shown in FIG. 7A and FIG. 7B).

In operation, pivotal positioning of back support member 22 from a substantially collapsed orientation (FIGS. 7A and 7B) toward and into a locked orientation within a desired one of retention means 36 and 37 (FIG. 9B through FIG. 10B), is accomplished by first pivoting foot support member 40 toward and into a substantially vertical orientation (FIG. 8B) relative to base bar 31 of base portion 21. Accordingly, when such positioning has occurred, the foot support bar will be in a back support member-clearing orientation—wherein such a clearing orientation will result in a void between the side regions, such as side region 38 (FIG. 8A) of the retention means, and the adjacent second wall surface, such as second wall surface 74 of slot 71 of front block region 30 of base portion 21, which is large enough for that portion of springedly positioned wire frame 34, located within the corresponding slot, to pivot in a relatively unobstructed manner to and from any operable orientations relative to the base portion.

Once the back support member has been pivotally positioned into a desired orientation, such as within lower retention means 36 (FIG. 9B), or upper retention means 37 (FIG. 10B), foot support member 40 can then be pivotally positioned toward and into its locking orientation, as shown in FIGS. 9A through 10B. When such a locked orientation has been achieved, that portion of the foot support member located within the corresponding slots, such as slot 71, of the front block region 30 of base portion 21, will serve to partially obstruct the void between the side regions of the retention means and the second wall surface, such as second wall surface 74, of the corresponding slot 71, 72, to, in turn, preclude inadvertent release and collapsing of the back support member from the retention means it is secured within.

Further securement of foot support member 40, and, in turn, back support member 22, in a locked orientation, is maintained as a result of engageable cooperation of the first end, such as first end 42 (FIG. 4, FIG. 6 and FIG. 11) of the foot support member with a corresponding foot securement means 41 (FIG. 6 and FIG. 11). Indeed, as foot support member 40 is pivoted into its back support member interfering orientation (FIG. 9A through FIG. 10B), the first ends of the foot support member will be forced into a snap-fit engagement with the foot securement means. Release from the foot securement means is simply accomplished by pushing or pulling foot support member toward a substantially vertical orientation with enough force to overcome the engagement by the foot securement means. Although foot support member 40 has been shown as comprising the mechanism for locking and unlocking the positioning of the back support member, it is also contemplated that the foot support member comprise a foot rest for an infant when seated on the apparatus.

Reorientation of back support member 22 into another orientation, such as at a higher or lower angle relative to the base portion, or even to a collapsed orientation, is simply accomplished by pivotally reorientating foot support member 40 back toward its substantially vertical back support member-clearing orientation (FIG. 8B), and then merely pivoting the back support member toward and into the orientation of choice—after drawing or compressing the first and second end regions inwardly towards each other against the spring bias of back support member 22. Although, the back support member is shown as being positionable into only two upright angular orientations relative to the base portion, more than two, or only one, angular position is also contemplated. Furthermore, it is important to note that the collapsed orientation of the back support member and the foot support member, as well as deployment of same, can be accomplished without disassembly and/or reassembly of a single component of the apparatus.

Toy bar 27 is shown in FIG. 1 and FIGS. 11 and 12 as comprising a first end region 60, a second end region (not shown) and position securement means 61. Position securement means, which include friction intensifying means, are operably attached to each of the first and second end regions of the toy bar for purposes of providing frictional rotational engagement with a juxtaposed bottom member 80 (FIG. 11) of base portion 21. The friction intensifying means are shown in FIGS. 13 and 14 as including spool member 62 operably secured to the respective end regions of toy bar 27, and elastomer 63 operably secured about spool 62. It is contemplated that the elastomer comprise any commercially available material having a high co-efficient of friction, such as polyurethane, to, in turn, enable toy bar 27 to be frictionally pivoted, and frictionally restrained, in any one of several orientations.

Another embodiment of position securement means 67 are shown in FIG. 15 and FIG. 16 as including a plurality of detents 68, 69 and 90. Such a construction enables the toy bar to be operably pivoted toward, and secured within, a particular orientation relative to the positioning of the detents. Additionally, it is contemplated that position securement means 67 comprise a modular clip-on component, or, alternatively, that it be integrally formed with base portion 21.

The foregoing description and drawings merely explain and illustrate the invention and the invention is not limited thereto except insofar as the appended claims are so limited, as those skilled in the art who have the disclosure before them will be able to make modifications and variations therein without departing from the scope of the invention.

What is claimed is:

1. A juvenile seat apparatus of the type having a base portion wherein said base portion is in a substantially single plane when said juvenile seat apparatus is in an infant accepting orientation, for cooperating with a supporting surface, and a back support member operably attached to said base portion, said juvenile seat apparatus comprising:

positioning means operably associated with said back support member and said base portion for enabling said back support member to be pivotally positionable relative to said base portion at a base-back pivot proximate said supporting surface, for positioning said back support member into one of at least two orientations, said positioning means including retention means operably associated with said base portion for releasably retaining said back support member in at least one of said at least two orientations; and locking means operably positioned proximate said base-back pivot in said base portion for operable association with said back support member, for releasably locking said back support member within said retention means and, in turn, for releasably locking said back support member in at least one of said at least two orientations, said locking means including a locking member pivotally positionable between a back support member-interfering orientation and a back support member-clearing orientation, wherein positioning of said locking member in said back support member-clearing orientation enables said back support member to be positionable into said one of said at least two orientations and wherein positioning of said locking member in said back support member-interfering orientation precludes said back support member from being operably released and re-oriented from said desired one of said at least two orientations to another orientation, thereby avoiding collapse of said back support member when a juvenile is seated in said apparatus.

2. The invention according to claim 1 wherein one of said at least two orientations of said back support member comprises said back support member being substantially juxtaposed to said base portion without having to disassemble said back support member from said base portion, so as to facilitate collapsibility, storage and transportation of said juvenile seat apparatus.

3. The invention according to claim 1 wherein said at least two orientations of said back support member comprises three orientations:

one of said three orientations of said back support member being substantially juxtaposed to said base portion without having to disassemble said back support member from said base portion so as to facilitate collapsibility, storage and transportation of said juvenile seat apparatus, the other two of said three orientations of said back support member being at various upright acute angles relative to said base portion.

4. The invention according to claim 1 wherein said base portion further includes handle means for facilitating carrying of said apparatus when said back support member and said base portion are positioned into a substantially collapsed orientation.

5. A juvenile seat apparatus of the type having a base portion and a back support member operably attached to said base portion, said juvenile seat apparatus comprising:

positioning means operably associated with said back support member and said base portion for enabling said back support member to be pivotally positionable relative to said base portion into one of at least two orientations, said positioning means including retention means operably associated with said base portion for releasably retaining said back support member in at least one of said at least two orientations; and locking means operably positioned in said base portion for operable association with said back support member, for releasably locking said back support member within said retention means and, in turn, for releasably locking said back support member in at least one of said at least two orientations, said locking means including a locking member pivotally positionable between a back support member-interfering orientation and a back support member-clearing orientation, wherein positioning of said locking member in said back support member-clearing orientation enables said back support member to be positionable into said one of said at least two orientations and wherein positioning of said locking member in said back support member-interfering orientation precludes said back support member from being operably released and re-oriented from said desired one of said at least two orientations to another orientation, thereby avoiding collapse of said back support member when a juvenile is seated in said apparatus, said locking member of said locking means comprising a foot support member pivotally attached to said base portion.

6. The invention according to claim 5 wherein said foot support member is pivotal to a position substantially juxtaposed to said base portion so as to facilitate collapsibility, storage and transportation of said juvenile seat apparatus.

7. The invention according to claim 5 wherein said juvenile seat apparatus further includes foot member securement means operably associated with said base portion for releasably securing said foot support member in said back support member-interfering orientation.

8. A juvenile seat apparatus of the type having a base portion and a back support member operably attached to said base portion, said juvenile seat apparatus comprising:

positioning means operably associated with said back support member and said base portion for enabling said back support member to be pivotally positionable relative to said base portion into one of at least two orientations, said positioning means including retention means operably associated with said base portion for releasably retaining said back support member in at least one of said at least two orientations; and locking means operably positioned in said base portion for operable association with said back support member, for releasably locking said back support member within said retention means and, in turn, for releasably locking said back support member in at least one of said at least two orientations, said locking means including a locking member pivotally positionable between a back support member-interfering orientation and a back support member-clearing orientation, wherein positioning of said locking member in said back support member-clearing orientation enables said back support member to be positionable into said one of said at least two orientations and wherein positioning of said locking member in said back support member-interfering orientation precludes said back support member from being operably released and re-oriented from said desired one of said at least two orientations to another orientation, thereby avoiding collapse of said back support member when a juvenile is seated in said apparatus, said retention means comprising a side region operably exposed to at least a portion of said back support member and a top end;

said side region having a cam-like surface and said top end having a detent;

at least a portion of said back support member being pivotally positioned over and past said cam-like surface of said side region so as to facilitate operable seating of said portion of said back support member in said detent of said top end to, in turn, releasably retain said back support member in said desired orientation.

9. A juvenile seat apparatus of the type having a base portion and a back support member operably attached to said base portion, said juvenile seat apparatus comprising:

positioning means operably associated with said back support member and said base portion for enabling said back support member to be pivotally positionable relative to said base portion into one of at least two orientations, said positioning means including retention means operably associated with said base portion for releasably retaining said back support member in at least one of said at least two orientations; and locking means operably positioned in said base portion for operable association with said back support member, for releasably locking said back support member within said retention means and, in turn, for releasably locking said back support member in at least one of said at least two orientations, said locking means including a locking member pivotally positionable between a back support member-interfering orientation and a back support member-clearing orientation, wherein positioning of said locking member in said back support member-clearing orientation enables said back support member to be positionable into said one of said at least two orientations and wherein positioning of said locking member in said back support member-interfering orientation precludes said back support member from being operably released and re-oriented from said desired one of said at least two orientations to another orientation, thereby avoiding collapse of said back support member when a juvenile is seated in said apparatus, said juvenile seat apparatus further comprising a toy bar pivotally associated with said base portion.

10. The invention according to claim 9 wherein said toy bar includes a first end region and a second end region:

said toy bar further including position securement means for operably securing said toy bar in two or more desired orientations relative to said base portion, said position securement means being operably associated with at least one of said first and second end regions of said toy bar and said base portion.

11. The invention according to claim 10 wherein said position securement means includes friction intensifying means operably associated with at least a portion of at least one of said first and second end regions of said back support means for providing frictional rotational engagement between said at least one of said first and second end regions and said base portion.

12. The invention according to claim 10 wherein said position securement means comprises two or more detent regions operably associated with said base portion;

at least one of said first and second end regions of said back support means being pivotally positionable, and, in turn, seatable, within a desired one of each of said at least two or more detent regions.

13. A cradle bouncer apparatus of the type having a base portion and a back support member operably attached to said base portion, said cradle bouncer apparatus comprising:

positioning means operably associated with said back support member and said base portion for enabling said back support member to be pivotally positionable relative to said base portion into one of at least two orientations, said positioning means including retention means operably associated with said base portion for releasably retaining said back support member in at least one of said at least two orientations; and locking means operably associated with said back support member for releasably locking said back support member within said retention means and, in turn, for releasably locking said back support member in said at least one of said at least two orientations, said locking means including a foot support member pivotally positionable between a back support member-interfering orientation and a back support member-clearing orientation, wherein positioning of said foot support member in said back support member-clearing orientation enables said back support member to be positionable into said one of said at least two orientations and wherein positioning of said foot support member in said back support member-interfering orientation precludes said back support member from being operably released and reoriented from said one of said at least two orientations to another orientation, thereby avoiding collapse of said back support member when an infant is seated in said apparatus.

14. The invention according to claim 13 wherein one of said at least two orientations of said back support member comprises said back support member being substantially juxtaposed to said base portion without having to disassemble said back support member from said base portion so as to facilitate collapsibility, storage and transportation of said cradle bouncer apparatus.

15. The invention according to claim 13 wherein said at least two orientations of said back support member comprises three orientations:

one of said three orientations of said back support member being substantially juxtaposed to said base portion without having to disassemble said back support member from said base portion so as to facilitate collapsibility, storage and transportation of said cradle bouncer apparatus, the other two of said three orientations of said back support member being at various upright acute angles relative to said base portion.

16. The invention according to claim 13 wherein said foot member is pivotal to a position substantially juxtaposed to said base portion so as to facilitate collapsibility, storage and transportation of said cradle bouncer apparatus.

17. The invention according to claim 13 wherein said cradle bouncer apparatus further includes foot member securement means operably associated with said base portion for releasably securing said foot support member in said back support member-interfering orientation.

18. The invention according to claim 13 wherein said retention means comprise a side region operably exposed to at least a portion of said back support member and a top end;

said side region having a cam-like surface and said top end having a detent;

at least a portion of said back support member being pivotally positioned over and past said cam-like surface of said side region so as to facilitate operable seating of said portion of said back support member in said detent of said top end to, in turn, releasably retain said back support member in said desired orientation.

19. The invention according to claim 13 wherein said cradle bouncer apparatus further comprises a toy bar pivotally associated with said base portion.

20. The invention according to claim 19 wherein said toy bar includes a first end region and a second end region:

said toy bar further including position securement means for operably securing said toy bar in two or more desired orientations relative to said base portion, said position securement means being operably associated with at least one of said first and second end regions of said toy bar and said base portion.

21. The invention according to claim 20 wherein said position securement means includes friction intensifying means operably associated with at least a portion of at least one of said first and second end regions of said back support means for providing frictional rotational engagement between said at least one of said first and second end regions and said base portion.

22. The invention according to claim 20 wherein said position securement means comprises two or more detent regions operably associated with said base portion;

at least one of said first and second end regions of said back support means being pivotally positionable, and, in turn, seatable, within a desired one of each of said at least two or more detent regions.

23. The invention according to claim 13 wherein said base portion further includes handle means for facilitating carrying of said apparatus when said back support member and said base portion are positioned into a substantially collapsed orientation.

* * * * *